US008167631B2

(12) United States Patent
Ito et al.

(10) Patent No.: US 8,167,631 B2
(45) Date of Patent: May 1, 2012

(54) CARD EDGE CONNECTOR

(75) Inventors: Toshiyasu Ito, Tougane (JP); Hiroaki Kukita, Kasukabe (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 13/005,881

(22) Filed: Jan. 13, 2011

(65) Prior Publication Data

US 2011/0189895 A1 Aug. 4, 2011

(30) Foreign Application Priority Data

Jan. 29, 2010 (JP) ..... 2010-019205

(51) Int. Cl.
*H01R 4/66* (2006.01)

(52) U.S. Cl. ..... 439/108

(58) Field of Classification Search ..... 439/108, 439/189, 497, 101, 636, 637, 660, 326, 60, 439/608, 607.08, 607.09, 742, 733.1, 74, 439/79, 869

See application file for complete search history.

(56) References Cited

U.S. PATENT DOCUMENTS

| | | | | |
|---|---|---|---|---|
| 6,273,762 | B1 * | 8/2001 | Regnier | 439/701 |
| 6,540,559 | B1 * | 4/2003 | Kemmick et al. | 439/607.05 |
| 6,648,657 | B1 * | 11/2003 | Korsunsky et al. | 439/108 |
| 6,743,057 | B2 * | 6/2004 | Davis et al. | 439/701 |
| 6,981,898 | B2 * | 1/2006 | Akama et al. | 439/607.09 |
| 7,025,617 | B2 * | 4/2006 | Regnier et al. | 439/329 |
| 7,273,381 | B2 | 9/2007 | Ito | |
| 7,303,410 | B2 * | 12/2007 | Saito | 439/108 |
| 7,458,829 | B2 * | 12/2008 | Shioda et al. | 439/108 |
| 7,674,118 | B2 * | 3/2010 | He | 439/108 |
| 7,682,193 | B2 * | 3/2010 | Stoner | 439/607.07 |
| 7,833,068 | B2 * | 11/2010 | Bright et al. | 439/733.1 |
| 2003/0186594 | A1 * | 10/2003 | Davis et al. | 439/701 |
| 2004/0235324 | A1 * | 11/2004 | Kimura et al. | 439/108 |
| 2004/0242071 | A1 * | 12/2004 | Ito et al. | 439/608 |
| 2007/0149058 | A1 * | 6/2007 | Saito | 439/608 |

FOREIGN PATENT DOCUMENTS

| | | |
|---|---|---|
| JP | 2000-067955 | 3/2000 |
| JP | 2004-079376 | 3/2004 |
| JP | 2007-149643 | 6/2007 |

OTHER PUBLICATIONS

Official Communication dated Nov. 8, 2011 in corresponding Japanese Patent Application No. 2010-019205 (4 pp. including 2 pp. translation).

* cited by examiner

*Primary Examiner* — Tulsidas C Patel
*Assistant Examiner* — Harshad Patel
(74) *Attorney, Agent, or Firm* — Finnegan, Henderson, Farabow, Garrett & Dunner, LLP

(57) ABSTRACT

The present invention provides a card edge connector as a high-speed differential signal connector configured to equalize electric potentials of ground contacts adjacent to signal line contacts, and thus to reduce crosstalk between adjacent signal line contacts. The card edge connector serves as a female connector in which multiple signal line contacts and multiple ground contacts are arranged in parallel in at least one row. In the card edge connector, the signal line contacts and the ground contacts are arranged in a way that every two signal line contacts for high-speed signals to send and return respectively therethrough are interposed between two ground contacts, and all of the multiple ground contacts arranged in the one row are electrically connected to one another by use of a common contact.

4 Claims, 14 Drawing Sheets

CARD EDGE CONNECTOR

This application claims the benefit of Japanese Patent Application No. 2010-019205, filed Jan. 29, 2010, which is hereby incorporated by reference herein in its entirety.

BACKGROUND OF THE INVENTION

1. Field of the Invention

The present invention relates to a card edge connector which is a female connector provided on a printed wiring board or the like. Particularly, the present invention relates to a card edge connector provided with a crosstalk reduction structure.

2. Description of the Related Art

As disclosed in Japanese Patent Laid-Open No. 2007-149643, for example, a technique has heretofore been well known for electrically connecting printed wiring boards to each other by providing one of the boards with a plug connector serving as a male connector while providing the other board with a card edge connector serving as a female connector.

For the purpose of suppressing crosstalk, contacts in such a connector are desirable to be arranged in a coplanar structure in which ground contacts (G) are arranged across signal line contacts (S) for sending and returning signals, that is to say, in a G-S-S-G layout.

In recent years, however, crosstalk between adjacent signal line contacts has become a serious problem along with an increase in the signal transmission speed. In particular, for the high-speed transmission, an amount of crosstalk even in a higher frequency band needs to be reduced to a very small level.

In general, a connector for transmitting differential signals has a structure in which ground contacts are respectively disposed on both sides of two signal line contacts as in the G-S-S-G layout described above. When two pairs of signal line contacts are located adjacent to each other, the two pairs of signal line contacts are separated from each other by only one common ground contact as seen in a G-S-S-G-S-S-G layout.

Ground wires to be located on a printed wiring board are connected to one another by use of a ground common plane or the like inside the printed wiring board, and are configured to have the same electric potential. On the hand, in a connector, multiple contacts are connected to the printed wiring board through only two contacts located on both end sides. In this case, the ground contacts are located at a distance from the ground common plane provided inside the print wiring board. For this reason, the ground contacts have different electric potentials, which are also different from an electric potential of the ground wires on the printed wiring board. Accordingly, the ground contacts degrade their shielding effects against high-frequency signals having a frequency component of several GHz. As a consequence, there is a risk of causing a problem of an increase in the crosstalk with an adjacent signal line contact or with a signal line contact next to the adjacent one.

With the problem taken into consideration, an object of the present invention is to provide a card edge connector as a high-speed differential signal connector configured to equalize electric potentials of ground contacts adjacent to signal line contacts, and thereby to reduce crosstalk between adjacent signal line contacts.

SUMMARY OF THE INVENTION

For the purpose of achieving the above-described object, a card edge connector according to the present invention is a card edge connector serving as a female connector in which multiple signal line contacts and multiple ground contacts are arranged in parallel in at least one row. The card edge connector is characterized in that the signal line contacts and the ground contacts are arranged in a way that every two signal line contacts for high-speed signals to send and return respectively therethrough are interposed between two ground contacts and in that all of the multiple ground contacts arranged in the one row are electrically connected to one another by use of a common contact.

The card edge connector may be configured in that multiple common contacts are provided and in that each of the common contacts electrically connects the two ground contacts between which the two signal line contacts are interposed. Alternatively, the card edge connector may be configured in that the common contact is capable of electrically connecting the multiple ground contacts to one another at the same time.

Furthermore, it is desirable that the card edge connector should includes a holder configured to hold the common contact in the case where the common contact is configured to be capable of electrically connecting the multiple ground contacts to one another at the same time.

According to the present invention, all the ground contacts for connecting the printed wiring boards can be held at the same electric potential by electrically connecting all the ground contacts by use of the common contacts as described above. This produces a shielding effect better than a conventional device, and can reduce crosstalk between signals passing through the respective signal line contacts disposed across a ground contact. Moreover, it is also possible to suppress occurrence of noises attributable to the signals passing through the respective signal line contacts.

Moreover, the common contact has a simple structure, and is easily assembled. With use of the common contact, the multiple ground contacts can be securely coupled together, and electrically connected to each other. In addition, materials are no longer wasted in a manufacturing process.

Further features of the present invention will become apparent from the following description of exemplary embodiments (with reference to the attached drawings).

DESCRIPTION OF THE EMBODIMENTS

Figure 1:
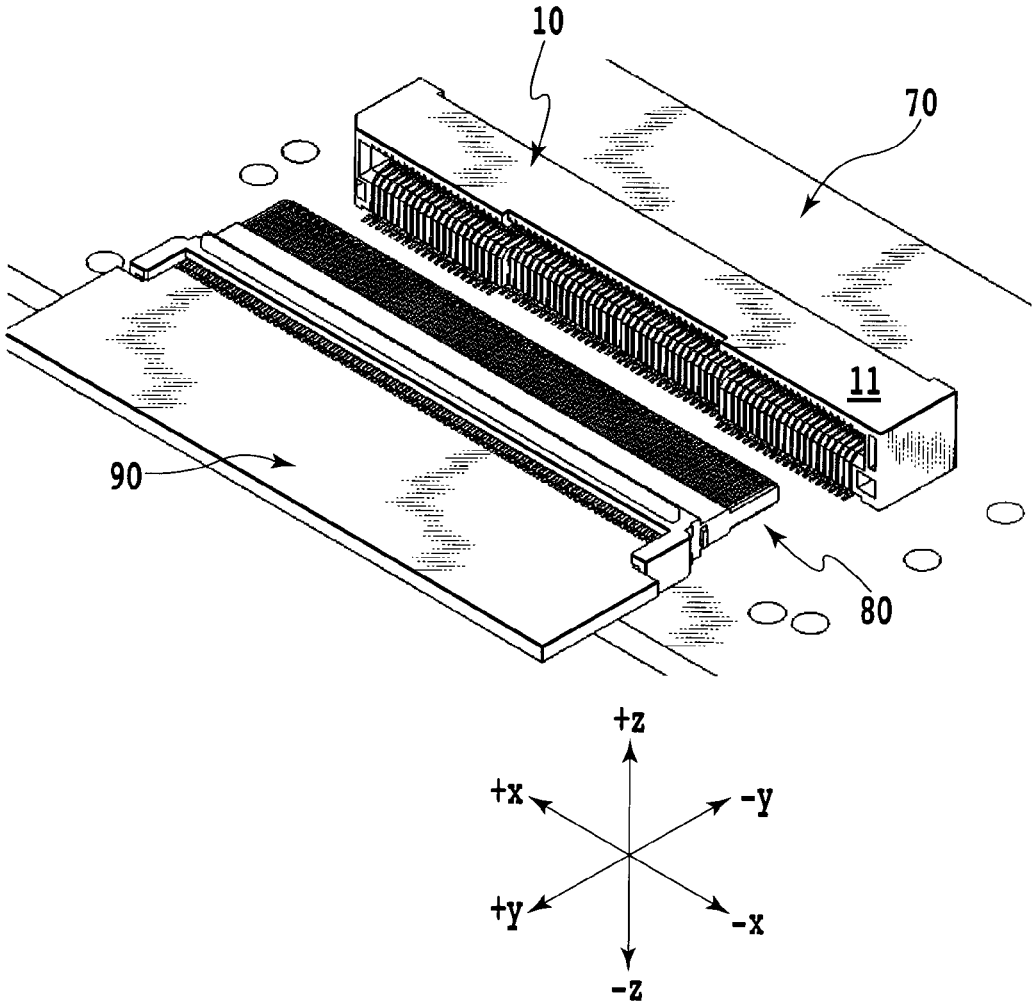
FIG. 1 is a perspective view of a connection mechanism between a printed wiring board provided with a card edge connector according to a first embodiment of the present invention and a printed wiring board provided with a plug connector, which is obliquely viewed from the upper right front.
Figure 2A:
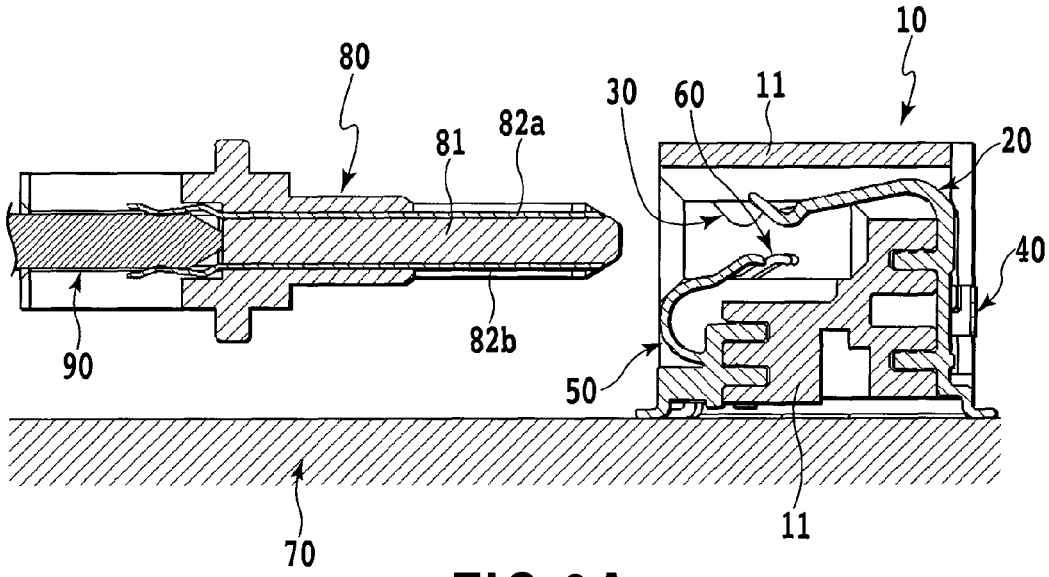
FIG. 2A is a cross-sectional view of the connection mechanism shown in FIG. 1, specifically, a cross-sectional view illustrating a state immediately preceding insertion of the plug connector into the card edge connector.
Figure 2B:
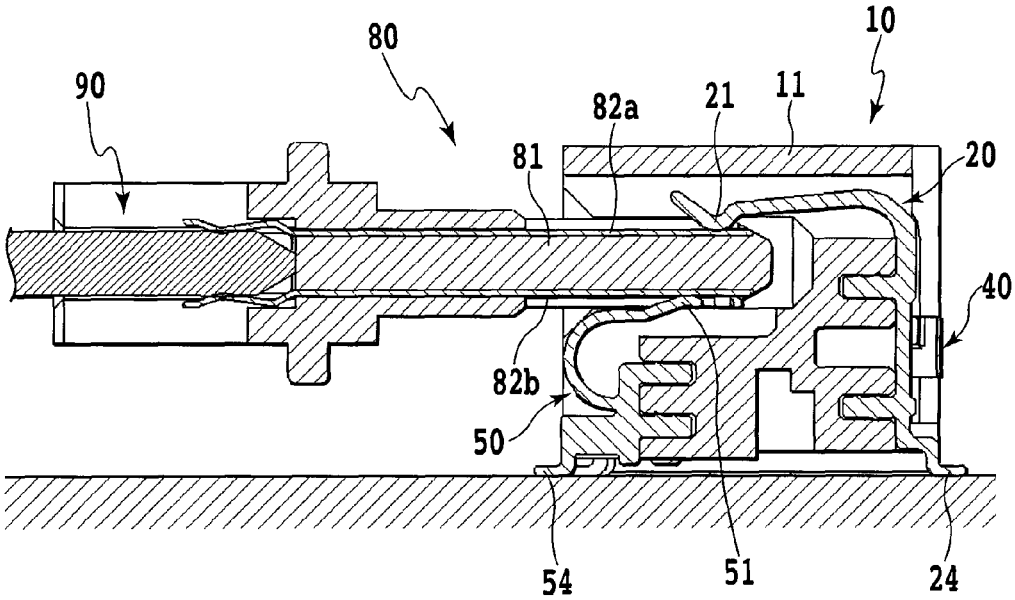
FIG. 2B is a cross-sectional view of the connection mechanism shown in FIG. 1, specifically, a cross-sectional view illustrating a state where electrical connection is completed with the plug connector inserted therein.

Hereinafter, preferred embodiments of a card edge connector of the present invention will be described with reference to the accompanying drawings.

First Embodiment

FIGS. 1 to 7 show a first embodiment of a card edge connector according to the present invention. In the description of this embodiment, it is to be noted that: "left" and "right" respectively mean a +x direction and a −x direction in FIG. 1; "front" and "back" respectively mean a +y direction and a −y direction: and "upper" and "lower" respectively mean a +z direction and a −z direction.

As shown in FIG. 1 to FIG. 7, a card edge connector 10 according to a first embodiment of the present invention is attached to a first printed wiring board 70. Meanwhile, a plug connector 80 to be inserted into the card edge connector 10 is attached to a second printed wiring board 90. The plug connector 80 is inserted into the card edge connector 10. Specifically, a blade 81 of the plug connector 80 is inserted into a plug connector receiving space 19*a* of the card edge connector 10. Accordingly, first and second pads 82*a*, 82*b* being respectively disposed on upper and lower surfaces of the blade 81 and functioning as external contact points contact their corresponding first and second signal line contacts 20, 50 as well as their corresponding first and second ground contacts 30,60 on the card edge connector 10. As a consequence, the first and second printed wiring boards 70, 90 are electrically connected to each other. Hence, it is possible to perform high-speed transmission of signals between the first and second printed wiring boards 70 and 90. In this case, the first and second ground contacts 30, 60 on the card edge connector 10 as well as the corresponding first and second pads on the plug connector are disposed across two signal line contacts or two pads for the sending and returning signals to pass. This embodiment is based on the assumption that: signals are transmitted at a high speed through the first pads 82*a* in the plug connector 80 and the first signal line contacts 20 in the card edge connector 10; and signals from a power source and the like are transmitted at a low speed through the second pads 82*b* and the second signal line contacts 50.

The card edge connector 10 according to this embodiment generally includes a main body 11, multiple common contacts 40, multiple first signal line contacts 20, multiple second signal line contacts 50, multiple first ground contacts 30, and multiple second ground contacts 60.

The main body 11 is made of an electrically insulating synthetic resin. Its profile generally is shaped like a cube, and extends in an elongated manner in the right-to-left direction in this embodiment. A receiving recessed portion 19 (see FIG. 2A and FIG. 7), in which the plug connector 80 is inserted, and multiple second slits 15, in which the multiple second signal line contacts 50 and the multiple second ground contacts 60 are respectively arranged, are formed on a front side of the main body 11. Meanwhile, multiple first slits 12, in which the multiple first signal line contacts 20 and the multiple first ground contacts 30 are respectively arranged, are formed on a back side of the main body 11.

The receiving recessed portion 19 is opened forward, extents horizontally in the right-to-left direction of the card edge connector 10, and defines the plug connector receiving space 19*a* so horizontally flat as to allow insertion of the plug connector 80. A vertical sectional shape of the plug connector receiving space 19*a* is preferably formed in a shape similar to a vertical sectional shape of the plug connector 80, as clearly shown in FIG. 7. Meanwhile, a front aperture 19*b* of the receiving recessed portion 19 is preferably opened such that dimensions thereof becomes larger toward its front in a tapered fashion in order to guide the insertion of the plug connector 80 smoothly.

Each of the multiple second slits 15 provided on the front side of the main body 11 is opened at least forward and toward the plug connector receiving space 19*a* defined by the receiving recessed portion 19. Namely, the second slits 15 are formed below the receiving recessed portion 19. To be more precise, the multiple second slits 15 extend in an anteroposterior direction. The multiple second slits 15 are formed in parallel to one another and at even intervals to be at a right angle to the above-described horizontal plug connector receiving space 19*a*. Meanwhile, a vertical sectional shape of each of the second slits 15 is formed substantially in the shape of the letter L, which is similar to a vertical sectional shape of either the second signal line contacts 50 or the second ground contacts 60 received therein. Accordingly, each of the second slits 15 includes: a vertical portion opened substantially forward; and a horizontal portion opened substantially toward the plug connector receiving space 19*a* (i.e., upward). Two fixation fixation press-fit holes 16, 17 for firmly fixing either a second signal line contact 50 or a second ground contact 60, which is received therein, inside their corresponding second slit 15 is formed in the vertical portion of each of the multiple second slits 15. The two fixation fixation press-fit holes 16 and 17 are formed almost horizontally and in parallel to each other.

Figure 3:
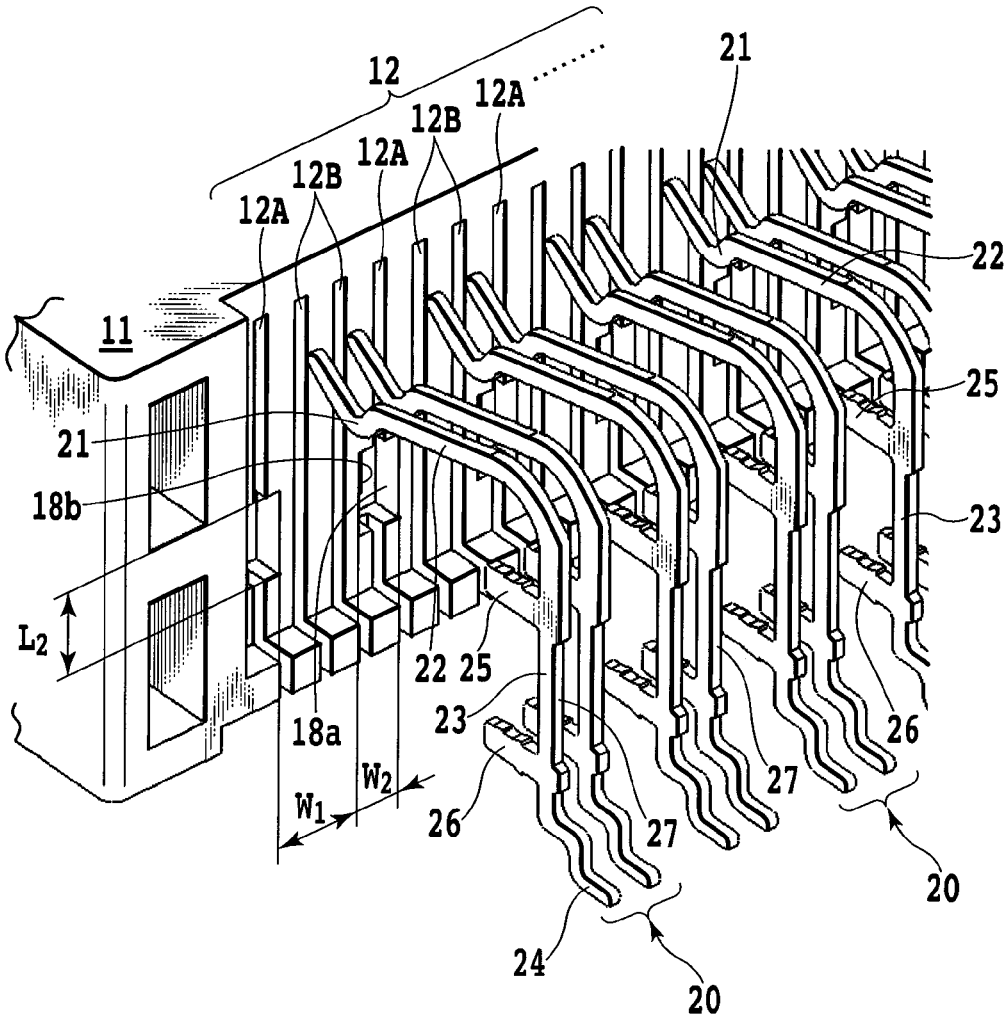
FIG. 3 is a view for explaining assembly of contacts in the card edge connector, specifically, a partial perspective view of the card edge connector shown in FIG. 1 which is viewed obliquely from the upper right back for illustrating a state of assembling signal contacts into the card edge connector.

Next, each of the multiple first slits 12 provided on the back side of the main body 11 is opened frontward, backward and toward the plug connector receiving space 19*a*. Specifically, part of each first slit 12 penetrates an upper part of the main body 11 in the anteroposterior direction. Meanwhile, the multiple first slits 12 are formed opposed to the multiple second slits 15 in pairs. To be more precise, like each second slit 15, each first slit 12 extends in the anteroposterior direction. In addition, the first slits 12 are formed in parallel to one another and at even intervals to be at a right angle to the above-described horizontal plug connector receiving space 19*a*. Meanwhile, a vertical sectional shape of each of the first slits 12 is formed substantially in the shape of the letter L, which is similar to a vertical sectional shape of either the first signal line contacts 20 or the first ground contacts 60 received therein. Accordingly, each of the first slits 12 includes: a vertical portion opened substantially forward; and a horizontal portion opened substantially toward the plug connector receiving space 19*a* (i.e., downward). Furthermore, in this embodiment, fixation fixation press-fit holes 13 and 14 for firmly fixing either a first signal line contact 20 or a first ground contact 30, which is received therein, inside their corresponding first slit 15 are formed in the vertical portion of each of the multiple first slits 12. The two fixation fixation press-fit holes 13 and 14 are formed almost horizontally and in parallel to each other. In this embodiment, among the multiple first slits 12, first slits 12A in which the first ground contacts are respectively received and first slit 12B in which the first signal line contacts are respectively received are different in configuration, only depending on whether or not engagement recessed portions to be described below are provided there. Specifically, first and second fitting recessed portions 18*a*, 18*b*, in which part of a first leg portion 42 of a common contact 40 and part of a second leg portion 43 of a neighboring common contact 40 are fitted, are further formed in a vertical portion of each of the slits 12A in which the first ground contacts are received, as shown in FIG. 3. The common contacts 40 will be described later. Fitting spaces in which the first and second leg portions 42, 43 of the common contacts 40 can be fitted are formed by the first and second fitting recessed portions 18*a*, 18*b*. The first fitting recessed portion 18*a* and the second fitting recessed portion 18*b* are formed in pair on both sides of the vertical portion of the first slit 12A, and are each formed to be opened backward and toward the first slit 12A. The first and second fitting recessed portions 18*a* and 18*b* have the same height (the same length in the vertical direction) $L_2$, which is set equal to a height $H_1$ of the common contacts 40 or at a length slightly greater than the height $H_1$. Meanwhile, when a width (a length in the right-to-left direction) of a fitting space to be formed by the first and second engagement recessed portions 18*a* and 18*b* is denoted by $W_2$, the width $W_2$ is set equal to any of a width $S_{21}$ of the first leg portions 42 and a width $S_{31}$ of the second leg portions 43 of the common contacts 40 (where $S_{21}=S_{31}$) or at a length slightly greater than the widths $S_{21}$, $S_{31}$. Further, when an interval between two neighboring fitting spaces is denoted by $W_1$, the interval $W_1$ is set equal to a width $S_1$ of the common contacts 40 or to a length slightly smaller than the width $S_1$.

Figure 7:
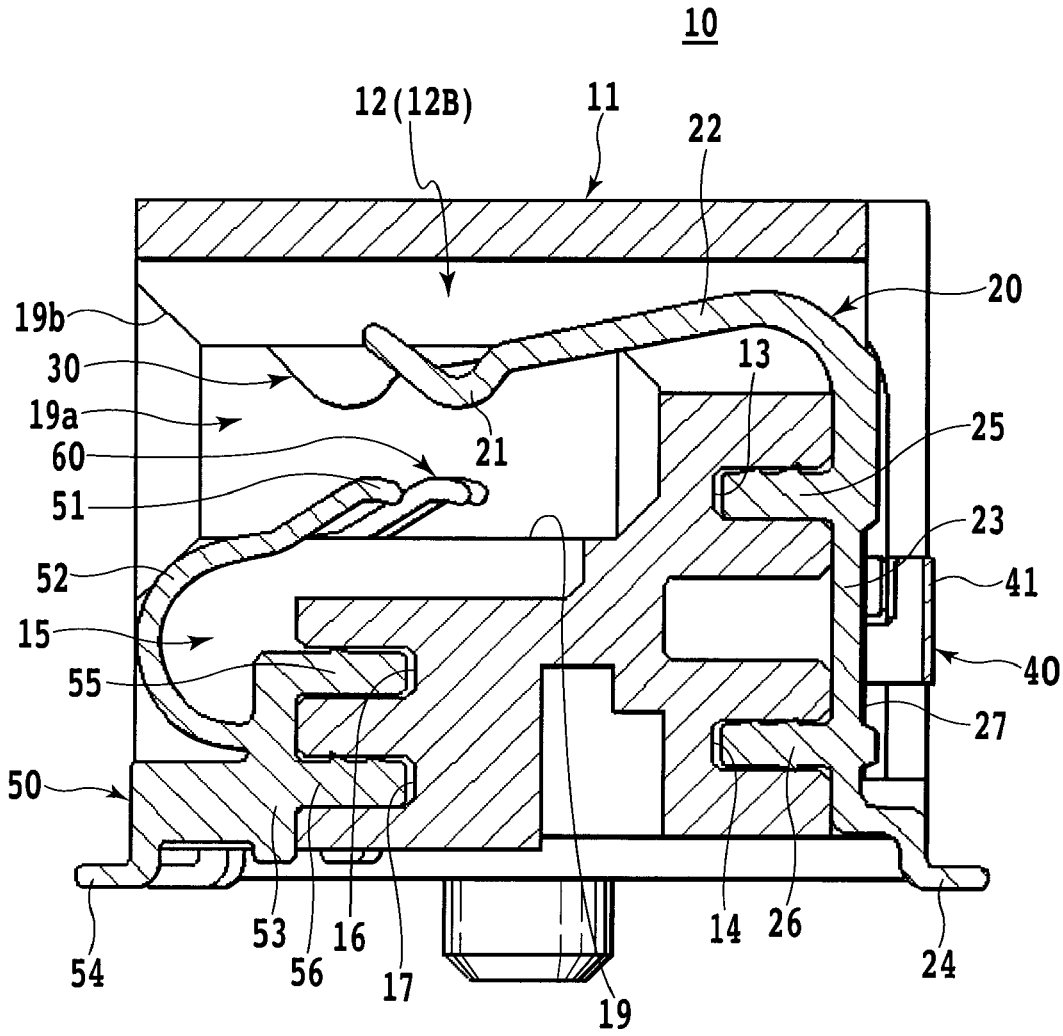
FIG. 7 is a cross-sectional view of the card edge connector according to the first embodiment, specifically, a cross-sectional view of the card edge connector taken in the vertical direction along a slit where a signal line contact is located.
Figure 8:
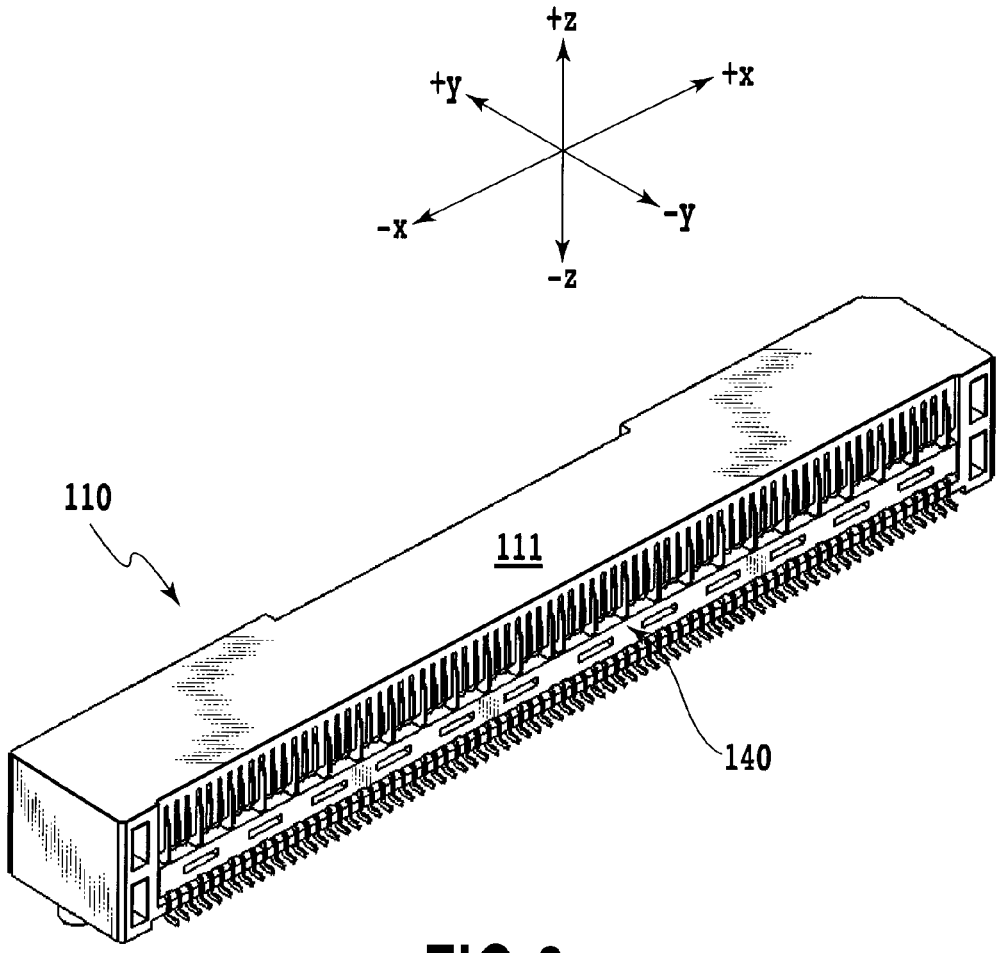
FIG. 8 is a perspective view of a card edge connector according to a second embodiment of the present invention which is obliquely viewed from the upper right back.

Next, the multiple second signal line contacts 50 of this embodiment are formed by punching, each almost in the form of the letter S, out of an electrically conductive metal thin plate. As shown in FIG. 7, each of the second signal line contacts 50 includes a contact point portion 51, an elastically deformable portion 52, a fixing portion 53, and a terminal portion 54 arranged beginning at the top.

In this embodiment, the contact point portion 51 has a shape which is curved protruding upward, and is formed to protrude into the plug connector receiving space 19*a*, so that the contact point portion 51 can contact the second pad 82*b* serving as a corresponding external contact point of the plug connector 80 at a desired contact pressure.

In this embodiment, the elastically deformable portion 52 is formed to extend forward from the fixing portion 53, to extend backward and upward while curved substantially in the form of the letter C, and to be continuous with the contact point portion 51. The elastic deformable portion 52 imparts the desired contact pressure to the contact point portion 51 by means of its elastic deformation.

In this embodiment, the fixing portion 53 is formed to support the contact point portion 51 and the elastic deformable portion 52 continuous therewith on a front side of the fixing portion 53, and extends perpendicularly in the vertical direction. Moreover, the fixing portion 53 includes two press-fit protrusions 55, 56 which are at a right angle to the fixing portion 53, and which protrudes from the fixing portion 53 in a direction (backward direction) opposite from the elastic deformable portion 52. The two press-fit protrusions 55, 56 are disposed in the vertical direction at an appropriate interval. The two press-fit protrusions 55, 56 are respectively press-fitted into the fixation fixation press-fit holes 16, 17 provided in each second slit 15 of the main body 11 of the card edge connector 10, and thus hold the corresponding signal line contact 50 to the card edge connector 10.

The terminal portion 54 is formed below the elastic deformable portion 52 supported by the fixing portion 53, i.e., formed to extend forward and downward from the fixing portion 53, so that the terminal portion 54 can be connected to an external contact point (not shown) of the printed wiring board 70. To be specific, the terminal portion 54 and the external contact point of the printed wiring board 70 are soldered together, and are electrically connected to an electric circuit of the printed wiring board 70.

Next, like the above-described second signal line contacts 50, the multiple second ground contacts 60 (see FIG. 7) are formed by punching them, each substantially in the form of the letter S, out of an electrically conductive metal thin plate. The second ground line contacts 60 each have almost the same structure as the second signal line contacts 50, and their description is therefore omitted. Incidentally, the length from a contact point portion to a fixing portion of each second ground contact 60 may be equal to that of each second signal line contact 50, or may be slightly longer or shorter than that of each second signal line contact 50.

On the other hand, the multiple first signal line contacts 20 of this embodiment are formed by punching them, each substantially in the form of the letter L, out of an electrically conductive thin metal plate. As shown in FIG. 7, each of the first signal line contacts 20 includes a contact point portion 21, an elastically deformable portion 22, a fixing portion 23, and a terminal portion 24, which are arranged beginning at the top.

In this embodiment, the contact point portion 21 has a shape which is curved protruding downward, and is formed to protrude into the plug connector receiving space 19*a*, so that the contact point portion 21 can contact the first pad 82*a* serving as a corresponding external contact point of the plug connector 80 at a desired contact pressure. In this respect, the first signal line contact 20 contacts the corresponding first pad 82*a* provided on the upper surface of the blade 81 of the plug contact 80. In the meantime, the second signal line contact 50 contacts the corresponding second pad 82*b* provided on the lower surface of the blade 81 of the plug contact 80. Accordingly, it is to be understood that the contact point portion 21 of the first signal line contact 20 protrudes toward the plug connector receiving space 19*a* from above while the contact point portion 51 of the second signal line contact 50 protrudes toward the plug connector receiving space 19*a* from under.

In this embodiment, the elastically deformable portion 22 is formed to extend forward and slightly downward from the fixing portion 23 while curved substantially in the shape of the letter L, and to be continuous with contact point portion 21. The elastic deformable portion 22 imparts a desired contact pressure to the contact point portion 21 by means of its elastic deformation.

In this embodiment, the fixing portion 23 is formed to support the contact point portion 21 and the elastic deformable portion 22 continuous therewith above the fixing portion 23 so as to locate the contact point portion 21 and the elastic deformable portion 22 on a front side of the fixing portion 23. The fixing portion 23 extends perpendicularly in the vertical direction with a length larger than the vertical length of the fixing portion 53 of the second signal line contact 50 for the purpose of causing the contact point portion 21 to protrude into the plug connector receiving space 19*a* from above as described previously. Moreover, the fixing portion 23 includes two press-fit protrusions 25, 26 which are at a right angle to the fixing portion 23, and which protrudes from the fixing portion 53 in the same direction (forward direction) as the elastic deformable portion 52 does. The two press-fit protrusions 25, 26 are disposed in the vertical direction at an interval $L_1$ which is larger than the interval between the above-described two press-fit protrusions 55, 56 of the second signal line contact 50. The two press-fit protrusions 25, 26 are press-fitted into the corresponding fixation fixation press-fit holes 13, 14 provided in the first slit 12 of the main body 11, and thus hold the corresponding first signal line contact 20 to the card edge connector 10.

The terminal portion 24 is formed to extend backward and downward from the fixing portion 23, so that the terminal portion 24 can be connected to an external contact point (not shown) of the printed wiring board 70. To be specific, as in the case of the above-described second signal line contact 50, the contact point portion 24 and the external contact point of the printed wiring board 70 are soldered together, and are electrically connected to the electric circuit of the printed wiring board 70.

Figure 5:
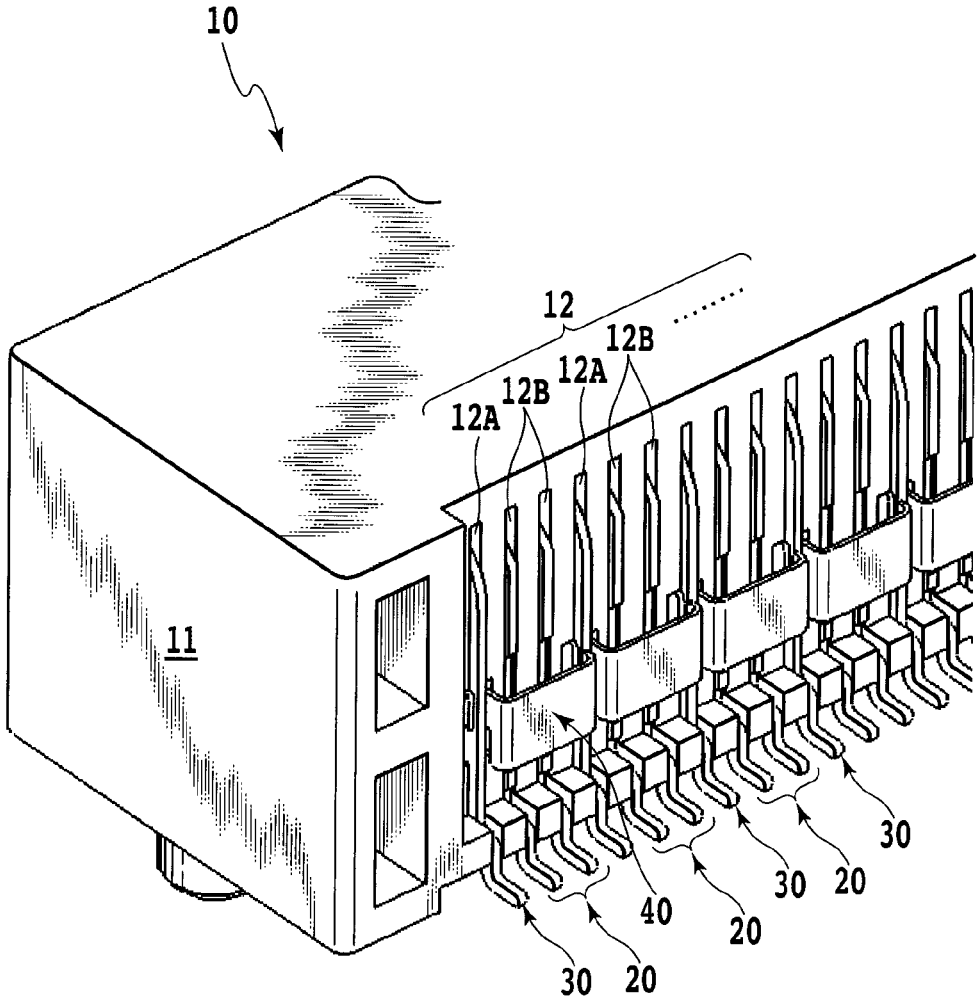
FIG. 5 is a partial perspective view of the card edge connector which is obliquely viewed from the upper right back for illustrating a state where the assembly is completed with ground contacts connected to one another by use of common contacts after the state shown in FIG. 4.

Furthermore, as illustrated in FIGS. 3 and 7, each first signal line contact 20 is provided with a clearance recessed portion 27 in the back side of the fixing portion 23. As shown in FIG. 5, the clearance recessed portion 27 is provided in order that, when the card edge connector is assembled, the corresponding common contact 40 for coupling the ground contacts 30 together should not contact the signal line contact 20. For this reason, no clearance recessed portion 27 may be provided there if permitted from the viewpoint of the design.

Next, like the above-described first signal line contacts 20, the multiple first ground contacts 30 according to this embodiment are formed by punching, each substantially in the form of the letter L, out of an electrically conductive metal thin plate. The first ground contacts 30 each have almost the same structure as the first signal line contacts 20, except for the clearance recessed part 27. For this reason, their description is omitted. However, the structure of each first ground contact 30 will be easily understood by reading the above description of the first signal line contact 20 while replacing the reference numerals in the twenties with those in the thirties. Note that the length from the contact point portion 31 to the fixing portion 33 of the first ground contact 30 may be equal to that of the first signal line contact 20, or may be set slightly longer or short than that of the first signal line contact 20.

Next, the common contacts 40 included in the card edge connector 10 according to this embodiment, which are a characteristic feature of the present invention, will be described with reference to FIGS. 6A and 6B. Each common contact 40 is a member for coupling the multiple first ground contacts 30 to be installed in the card edge connector 10 for the purpose of making the electric potentials of the first ground contacts 30 equal to one another. The common contact of this embodiment is formed by punching out of an electric conductive metal thin plate and then bending.

The common contact 40 according to this embodiment couples together first ground contacts 30 received in the respective first slits 12A disposed every third slit, and thus electrically connects the first ground contacts 30 to each other. To be specific, the common contact 40 according to this embodiment couples only two ground contacts, namely, a first ground contact 30 disposed in a certain first slit 12A and another first ground contact 30 disposed in a first slit 12*a* on the right or left of the certain first slit 12A. Accordingly, the multiple common contacts 40 are prepared in this embodiment, and all the first ground contacts 30 assembled in the card edge connector 10 are electrically connected to one another. By applying this configuration, electric potentials become equal throughout ground conductive wires formed by all the first ground contacts 30 and the ground contacts (pads) 82*a* which are arranged between the two printed wiring boards 70 and 90. This prevents reduction in a shielding effect of the ground conductive wires in two connector regions of the plug connector 80 and the card edge connector 10, reduces cross talk, and prevents noise emission.

Each common contact 40 according to this embodiment includes: a flat main body 41; and the first and second leg portions 42, 43 which are formed by bending both of the right and left end portions of the main body 41. The main body 41 is formed as a plate body shaped substantially like a rectangle having a height (a length in the vertical direction) $H_1$ and a width (a length in the right-to-left direction) $S_1$.

The first leg portion 42 includes: a bent portion 42*b* which is bent forward from a left end portion of the main body 41 in a way to be at a right angle to the main body 41; and a folded-back portion 42*a* which is folded back outward (leftward) from the bent portion 42*b*. In the first leg portion 42, the bent portion 42*b* having a height $H_2$ from its lower end surface extends forward from a lower side of the left end portion of the main body 41, and is folded back in the form of the letter U at a predetermined position, whereby the folded-back portion 42*a* extends backward. The folded-back portion 42*a* has the same height $H_2$ as the bent portion 42*b*, and is parallel to the bent portion 42*b*. Moreover, the folded-back portion 42*a* is folded backward from the bent portion 42*b* with a clearance $S_2$ between the folded-back portion 42*a* and the bent portion 42*b* so as to form a clamping portion 42*c*. The fixing portion 33 of the first ground contact 30 is fitted into the clamping portion 42*c*. In other words, the fixing portion 33 is pinched by the bent portion 42*b* and the folded-back portion 42*a*. The height $H_2$ of the first leg portion 42 is almost half the height $H_1$ of the main body 41 ($H_2=½×H_1$), while the clearance $S_2$ between the bent portion 42*b* and the folded-back portion 42*a* of the first leg portion 42 is almost equal to a plate thickness of the first ground contact 30. Incidentally, as shown in FIG. 6A, a lower end surface of the first leg portion 42 is flush with the lower end surface of the main body 41.

The second leg portion 43 includes: a bent portion 43*b* which is bent forward from a right end portion of the main body 41 in a way to be at a right angle to the main body 41; and a folded-back portion 43*a* which is folded back outward (rightward) from the bent portion 43*b*. In the second leg portion 43, the bent portion 43*b* having a height $H_3$ from its upper end surface extends forward from an upper side of the right end portion of the main body 41, and is folded back in the form of the letter U at a predetermined position, whereby the folded-back portion 43*a* extends backward. The folded-back portion 43*a* has the height $H_3$ which is equal to the height of the bent portion 43*b*, and is parallel to the bent portion 43*b*. Moreover, the folded-back portion 43*a* is folded backward from the front end of the bent portion 43*b* with a clearance $S_3$ between the folded-back portion 43*a* and the bent portion 43*b* so as to form a clamping portion 43*c*. The fixing portion 33 of the first ground contact 30 is fitted into the clamping portion 43*c*. In other words, the fixing portion 33 is pinched by the bent portion 43*b* and the folded-back portion 43*a*. As described above, the height $H_3$ of the second leg portion 43 is equal to the height of the bent portion 43*b*, and is almost half the height $H_1$ of the main body 41 ($H_2=H_3=½×H_1$). Meanwhile, the clearance $S_3$ of the clamping portion 43*c* formed between the bent portion 43*b* and the folded-back portion 43*a* of the second leg portion 43 is almost equal to the plate thickness of the first ground contact 30 ($S_2=S_3$). As understood from the above description and from FIG. 6A, the second leg portion 43 is located in a position point-symmetrical to the first leg portion 42 with respect to the main body 41.

When the common contact 40 is formed as described above, the common contact 40 has a simple structure, can be easily assembled, and makes it possible to electrically connect the multiple first ground contacts 30 to one another while securely coupled together. Moreover, the materials are no longer wasted in the manufacturing process.

Figure 6A:
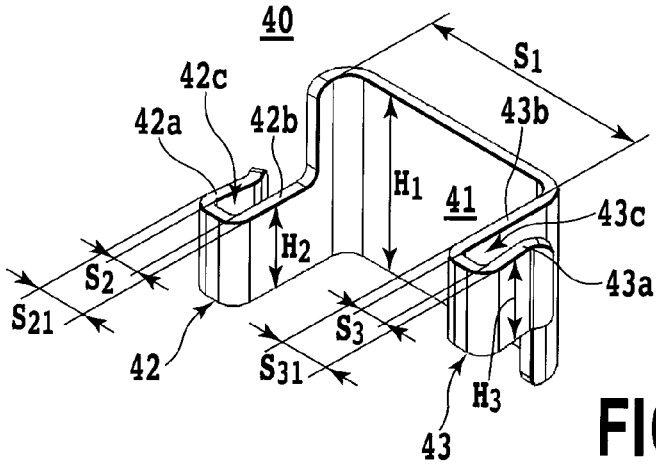
FIG. 6A is a view showing details of one of the common contacts of a first embodiment, specifically, a perspective view of the common contact which is obliquely viewed from the upper right front.
Figure 6B:
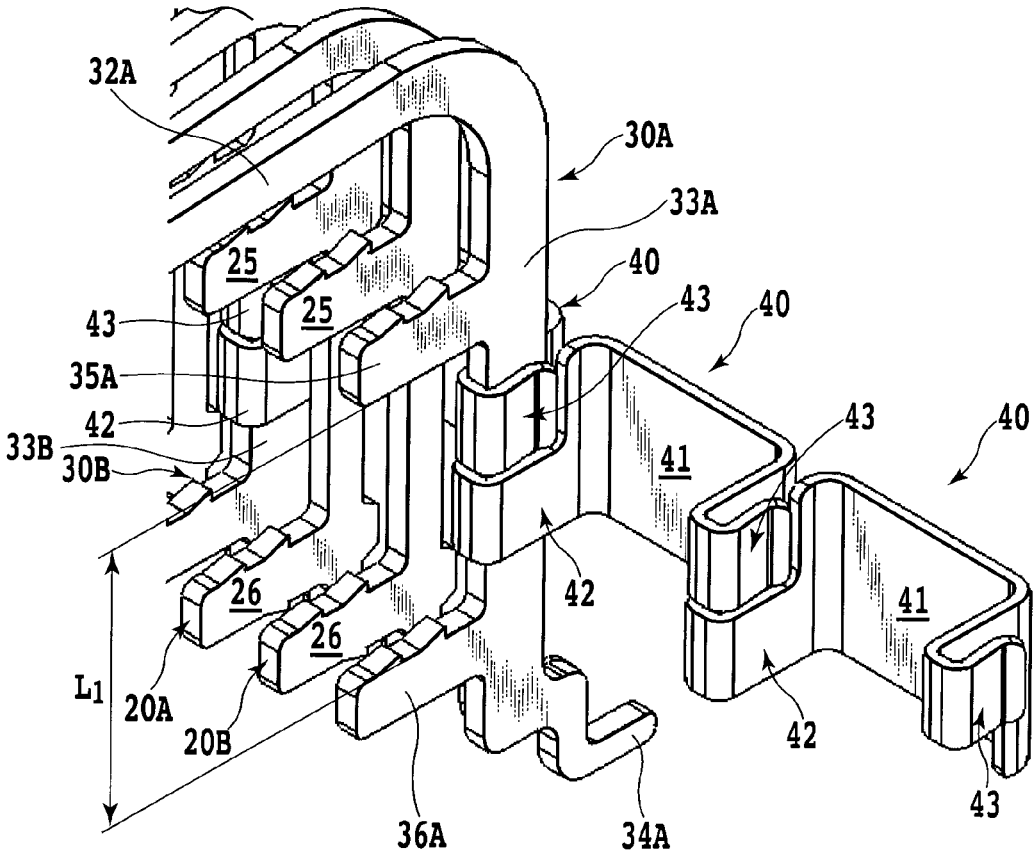
FIG. 6B is a view showing the details of the common contact of the first embodiment, specifically, a partial perspective view of the common contact which is obliquely viewed from the upper right front for illustrating in detail a state where ground contacts are coupled to one another by use of common contacts.

Note that, as shown in FIG. 6A, the lower end surface of the first leg portion 42 is flush with the lower end surface of the main body 41. Moreover, in this embodiment, the first leg portion 42 is provided on the lower side of the left end portion of the main body 41 while the second leg portion 43 is provided on the upper side of the right end portion. However, the present invention is not limited only to this configuration. The first leg portion 42 may be provided on the upper side of the left end portion while the second leg portion 43 may be provided on the lower side of the right end portion.

The two first ground contacts 30, 30 are coupled to each other by use of the common contact 40 having the above-described configuration. As shown in FIG. 6B, the common contact 40 according to this embodiment couples two first ground contacts 30A, 30B to each other across two first signal line contacts 20A, 20B. To be more specific, as shown in FIG. 6B, the second leg portion 43 of the common contact 40 pinches a fixing portion 33A, which extends perpendicularly in the vertical direction, between two press-fit protrusions 35A, 36A provided on the fixing portion 33A of the first ground contact 30A. In other words, the fixing portion 33A is fitted into the clamping portion 43*c* formed by the bent portion 43*b* and the folded-back portion 43*a* configuring the second leg portion 43, whereby the first ground contact 30A and the common contact 40 are electrically connected together. Meanwhile, like the second leg portion, the first leg portion 42 of the common contact 40 clamps a fixing portion 33B of each of the first ground contacts 30B which are located across the two first signal line contacts 20A, 20B. At this time, the first leg portion 42 is located below a second leg portion 43 of another common contact 40 for coupling the first ground contact 30B and another first ground contact (not shown) located on its farther side (left side). The aspect of laying out these two leg portions 42, 43 is similar to an aspect of laying out the first leg portion 42 and the second leg portion 43 of the two common contacts 40 clamping the first ground contact 30A. Incidentally, in FIG. 6B, reference numerals 32A, 34A denote the elastic deformable portion and the terminal portion of the first ground contact 30A, respectively.

Figure 4:
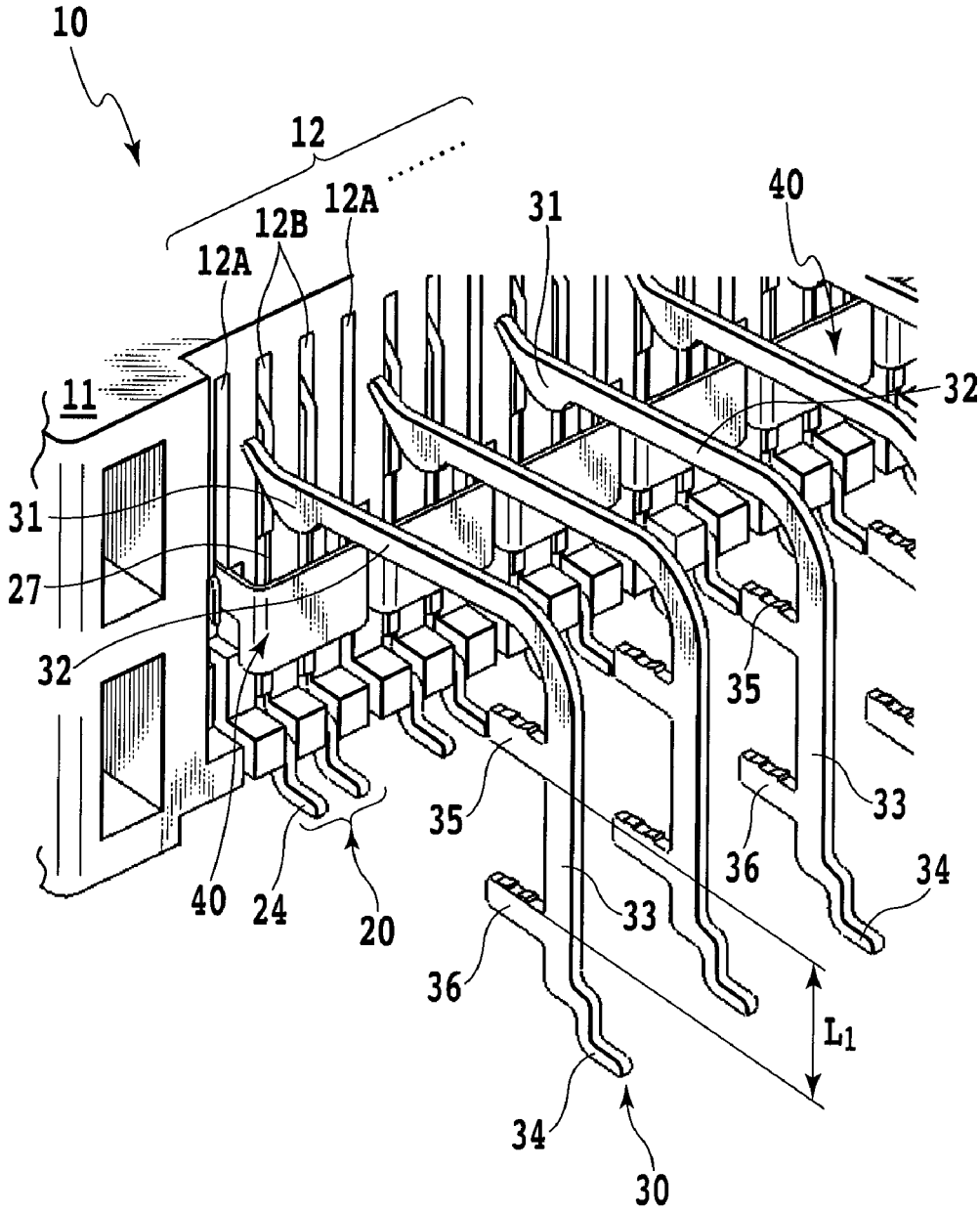
FIG. 4 is a partial perspective view of the card edge connector which is obliquely viewed from the upper right back for illustrating a state of assembling ground contacts into the card edge connector after the state shown in FIG. 3.

Next, assembling method of the first signal line contacts 20 and the first ground contacts 30 into the card edge connector 10 according to this embodiment will be briefly described by using FIGS. 3 to 5. It should be noted, however, that an assembly method described herein is merely an example. For instance, another assembly method may be used in which: the first ground contacts 30 and the common contacts 40 are assembled together in advance; and these assembled constituents are fitted into the main body 11 of the card edge connector 10.

First, as shown in FIG. 3, the first signal line contacts 20 are inserted into the corresponding slits 12B of the first slits 12, and are fixed to the main body 11 of the card edge connector 10. Two first signal line contacts 20, paring with each other, are inserted respectively into two adjacent slits 12B on the left side of one slit 12A located in the right end (the left end in FIG. 3) while leaving the one slit 12A vacant in order for a ground contact 30 to be later received therein. The next paired first signal line contacts 20 are inserted respectively into two adjacent slits 12B on the left side of another slit 12A while leaving the slit 12A vacant in order for another first ground contact 30 to be later received therein as well. Subsequently, by repeating this operation, all the first signal line contacts 20 are inserted into the corresponding slits 12B. Thereby, the installation of the first signal line contacts 20 in the main body 11 of the card edge connector 10 is completed. Incidentally, the first slits 12 are formed in the main body 11 so that a first ground contact 30 can be received in a slit 12A located on the left end.

Next, as shown in FIG. 4, the multiple common contacts 40 are installed in the main body 11 of the card edge connector 10 by use of the fitting spaces which are provided in the predetermined slits 12A, and each of which is formed from the first and second fitting recessed portions 18*a*, 18*b* making a pair. The multiple common contacts 40 are held by the main body 11 by inserting the first and second leg portions 42, 43 of each common contact 40 into the corresponding fitting spaces with the layout shown in FIG. 6B. In this state, the multiple first ground contacts 30 are fixed to the main body 11 of the card edge connector 10 while inserted into the corresponding first slits 12A. On this occasion, the fixing portions 33 of the respective first ground contacts 30 are pinched by the first and second leg portions 42, 43 of the common contacts 40 at the same time.

In this way, the first signal line contacts 20 and the first ground contacts 30 are received in the corresponding first slits 12A, 12B with a G-S-S-G layout, as shown in FIG. 5. Meanwhile, all the first ground contacts 30 received thus are installed in the main body 11 of the card edge connector 10 while electrically connected together by use of the multiple common contacts according to this embodiment.

By coupling all the first ground contacts 30 to one another by use of the multiple common contacts 40 as described above, all the ground contacts connecting the printed wiring boards together are held at the same electric potential. This produces a shielding effect better than a conventional device, and thereby can reduce crosstalk between signals passing through the signal line contacts disposed across the ground contacts. Furthermore, it is also possible to suppress occurrence of noise attributable to the signals passing through the signal line contacts as in the case of the conventional device.

In this embodiment, since signals are transmitted at a high-speed through each two first signal line contacts for sending and returning signals to pass, the description has been given for the case where the common contacts are provided only to the first ground contacts across every two adjacent first signal line contacts. However, the common contacts need to be provided to the second ground contacts across every two adjacent second signal line contacts in the case where signals are transmitted at a high speed through the second signal line contacts. In this case, the second ground contacts can be coupled to one another by using the common contacts if the second signal line contacts and the second ground contacts are formed, for instance, in accordance with a second embodiment to be described below.

Second Embodiment

FIGS. 8 to 14 show the second embodiment of the card edge connector according to the present embodiment. This embodiment is different from the above-described first embodiment in the configuration of a common contact. In conjunction with this, configurations of the first signal line contacts and the first ground contacts as well as a structure for the connection of the first ground contacts by using the common contacts are different. Hereinafter, descriptions will be provided focusing on those differences. In this embodiment as well, let us assume that signals are transmitted at a high speed only through the first signal contacts as in the case of the first embodiment.

In the description of this embodiment, it should be noted that: "left" and "right" respectively mean a +x direction and a −x direction in FIG. 8; "front" and "back" respectively mean a +y direction and a −y direction; and "upper" and "lower" respectively mean a +z direction and a −z direction.

A card edge connector 110 according to the second embodiment of the present invention is attached to the first printed wiring board (not shown) as in the case of the first embodiment thereof. Moreover, as in the case of the first embodiment, the plug connector 80 being attached to the second printed wiring board (not shown) is inserted into the card edge connector 110 whereby the printed wiring boards are electrically connected to each other. Furthermore, the layout of the signal line contacts (S) and the ground contacts (G) inside the card edge connector 110 is the G-S-S-G layout in common with the first embodiment.

The card edge connector 110 according to this embodiment generally includes a main body 111, common contacts 140, a holder 145, multiple first signal line contacts 120, multiple second signal line contacts 150, multiple first ground contacts 130, and multiple second ground contacts 160.

First of all, the main body 111 of the card edge connector 110 according to this embodiment will be described.

In this embodiment, too, the main body 111 is made of an electrically insulating synthetic resin as in the case of the first embodiment, as well as its profile generally is shaped like a cube and extends in an elongated manner in the right-to-left direction.

This embodiment is different from the first embodiment only in that the main body 111 is different in the configurations of fixation press-fit holes provided on the slits for receiving the contacts and in the structure for attaching the holder 145 thereto. All the other structures of the main body 111 are completely the same as those in the first embodiment.

In this embodiment, one fixation press-fit hole 118A is formed on multiple first slits 112 which are provided on a back side of the main body 111, and in which first signal line contacts 120 and first ground contacts 130 are received. The fixation press-fit hole 118A is formed to extend substantially in the horizontal direction across the vertical portions of the multiple first slits 112 in order to fix the first signal line contacts 120 or the first ground contacts 130 to the main body 111 inside the first slits 112, respectively. The fixation press-fit hole 118A has a height (a length in the vertical direction) which is almost equal to a distance $L_3$ between an upper surface of a first horizontal press-fitting portion 123*b* and a lower surface of a second horizontal portion 123*d* of a fixing portion 123 of each first signal line contact 120 to be described later. Moreover, the fixation press-fit hole 118A has a depth (a length in the anteroposterior direction) which is almost equal to a distance $L_5$ between a front end surface of a first vertical portion 123*a* and a frond end surface of a vertical press-fit portion 123*c*. That is to say, the fixation press-fit hole 118A has a vertical sectional shape which is a substantially rectangular shape having the height $L_3$ and the depth $L_5$.

Meanwhile, cutout recessed portions 112*b* are formed on partition walls 112*a* configured to partition the adjacent first slits 112 of the main body 111 so as to insert the holder 145, which will be described later, into the fixation press-fit hole 118A. Each of the cutout recessed portions 112*b* is opened backward, and is formed to traverse the main body 111 in the right-to-left direction. The cutout recessed portion 112*b* has a height that is almost equal to a height $H_{21}$ of the holder 145, and a depth that is equivalent to a length obtained by subtracting a width (a length in the anteroposterior direction) of a first vertical portion 133*a* of a fixing portion 133 of the first ground contact 130 from a depth $T_{21}$ of the holder 145. That is to say, the cutout recessed portion 112*b* has a vertical sectional shape which is a substantially rectangular shape having the height $H_{21}$ and the depth $[T_{21}-(L_6-L_5)]$.

Meanwhile, at least one fixation press-fit hole 118B is formed in multiple second slits 115 which are provided on a front side of the main body 111, and in which second signal line contacts 150 and second ground contacts 160 are received. The fixation press-fit hole 118B is formed substantially horizontally in the vertical portions of the multiple second slits 115 in order to fix the second signal line contacts 150 or the second ground contacts 160 to the main body 111 inside the second slits 115, respectively.

The other structures of the main body 111 are substantially the same as those of the main body 11 according to the above-described first embodiment, and description for them will be therefore omitted. However, the other structures of the main body 111 of this embodiment will be easily understood by reading the above description of the main body 11 according to the first embodiment while adding 100 to each of the reference numerals therein.

Figure 10:
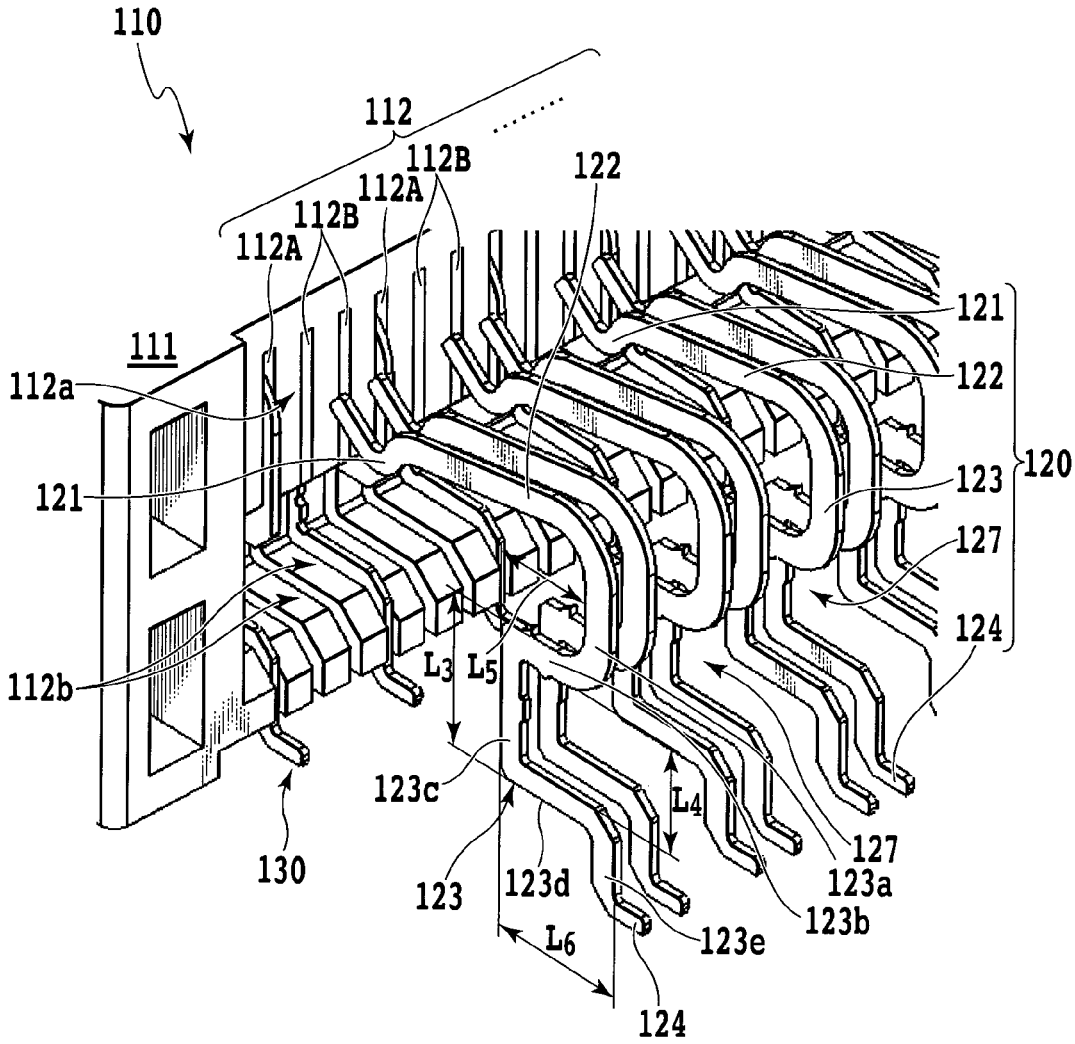
FIG. 10 is a view for explaining the assembly of the contacts in the card edge connector, specifically, a partial perspective view of the card edge connector which is viewed obliquely from the upper right back for illustrating a state of assembling signal line contacts into the card edge connector after the state shown in FIG. 9.

Next, the first signal line contacts 120 according to this embodiment, which are different in the structure from those according to the first embodiment, will be described. Each of the multiple first signal line contacts 120 of this embodiment is formed by punching, substantially in the form of the letter S, out of an electrically conductive metal thin plate, and includes a contact point portion 121, an elastically deformable portion 122, a fixing portion 123, and a terminal portion 124 from the top to the bottom as shown in FIG. 10.

This embodiment is different from the above-described first embodiment only in that the structure of the fixing portions 123 is different from that of the fixing portions 23, and the other configurations of this embodiment are substantially the same as those of the first embodiment. The fixing portions 123 of this embodiment do not extend perpendicularly in the vertical direction unlike the fixing portions 23 of the above-described first embodiment, each of which extends from the elastic deformable portion 22 to the terminal portion 24. As shown in FIG. 10, each fixing portion 123 of this embodiment protrudes forward in the form of the letter C. To be more specific, the fixing portion 123 of this embodiment includes a first vertical portion 123*a*, a first horizontal press-fit portion 123*b*, a vertical press-fit portion 123*c*, a second horizontal press-fit portion 123*d*, and a second vertical portion 123*e* that is continuous to the terminal portion 124.

The first vertical portion 123*a* continues from the elastic deformable portion 122, and extends downward in the vertical direction. The first horizontal press-fit portion 123*b* is at a right angle to the first vertical portion 123*a*, and extends forward from a lower end of the first vertical portion 123*a*. The vertical press-fit portion 123*c* is at a right angle to the first horizontal press-fit portion 123*b*, and extents downward in the vertical direction from a front end of the first horizontal press-fit portion 123*b*. The second horizontal press-fit portion 123*d* is at a right angle to the vertical press-fit portion 123*c*, and extends backward from a lower end of the vertical press-fit portion 123*c*. Moreover, the second vertical portion 123*e* is at a right angle to the second horizontal press-fit portion 123*d*, extends downward in the vertical direction from a rear end of the second horizontal press-fit portion 123*d*, and continues to the terminal portion 124. Accordingly, in this embodiment, the first signal line contact 120 forms a holder receiving recessed portion 127 for receiving the holder 145, which will be described later, by use of the first and second horizontal press-fit portions 123*b*, 123*d* and the vertical press-fit portion 123*c*. Note that at least a rear end surface of the first vertical portion 123*a* and a rear end surface of the second vertical portion 123*e* are preferably located on the same perpendicular plane in the vertical direction. In this embodiment, a distance between a front end surface of the first vertical portion 123*a* and a front end surface of the vertical press-fit portion 123*c* will be denoted by $L_5$, and a distance between a rear end surface of the first vertical portion 123*a* (or the second vertical portion 123*e*) and the front end surface of the vertical press-fit portion 123*c* will be denoted by $L_6$. Meanwhile, a distance between an upper surface of the first horizontal press-fit portion 123*b* and a lower surface of the second horizontal press-fit portion 123*d* will be denoted by $L_3$, and a distance between a lower surface of the first horizontal press-fit portion 123*b* and an upper surface of the second horizontal press-fit portion 123*d* will be denoted by $L_4$.

Next, descriptions will be provided for the first ground contacts 130 according to this embodiment. Like the above-described first signal line contacts 120, the multiple first ground contacts 130 are formed by punching, each substantially in the form of the letter S, out of an electrically conductive metal thin plate. The structure of each first ground contact 130 is different from the above-described structure of the first signal line contact 120 only in that: the first ground contact includes two contact protrusions 135, 136 which are located on a rear end surface of a vertical press-fit portion 133*c* of a fixing portion 133 and a distance $L_4$ is set slightly smaller than that of the first signal line contact 120. The two contact protrusions 135, 136 are formed to contact a common contact 140, and protrude backward from the rear end surface of the vertical press-fit portion 133*c*. Meanwhile, the purpose of setting the distance $L_4$ slightly smaller than that of the first signal line contact 120 is to enable the first ground contact 130 to contact the common contact 140.

The structure of each first ground contact 130 is substantially the same as that of the above-described first signal line contact 20, except for the contact protrusions 135, 136. For this reason, description for it will be omitted. However, the rest of the structure of the first ground contact 130 of this embodiment will be easily understood by reading the above description of the first signal line contact 120 while replacing the reference numerals in the one-hundred twenties with reference numerals in the one-hundred thirties. Incidentally, in this embodiment, a length from a contact point portion 131 to a fixing portion 133 of the first ground contact 130 may be set slightly longer than that of the first signal line contact 120. Meanwhile, a distance between a rear end surface of a first vertical portion 133*a* (or a second vertical portion 133*e*) and a front end surface of the vertical press-fit portion 133*c* may be set slightly larger than the distance $L_5$ of the first signal line contact.

Figure 14:
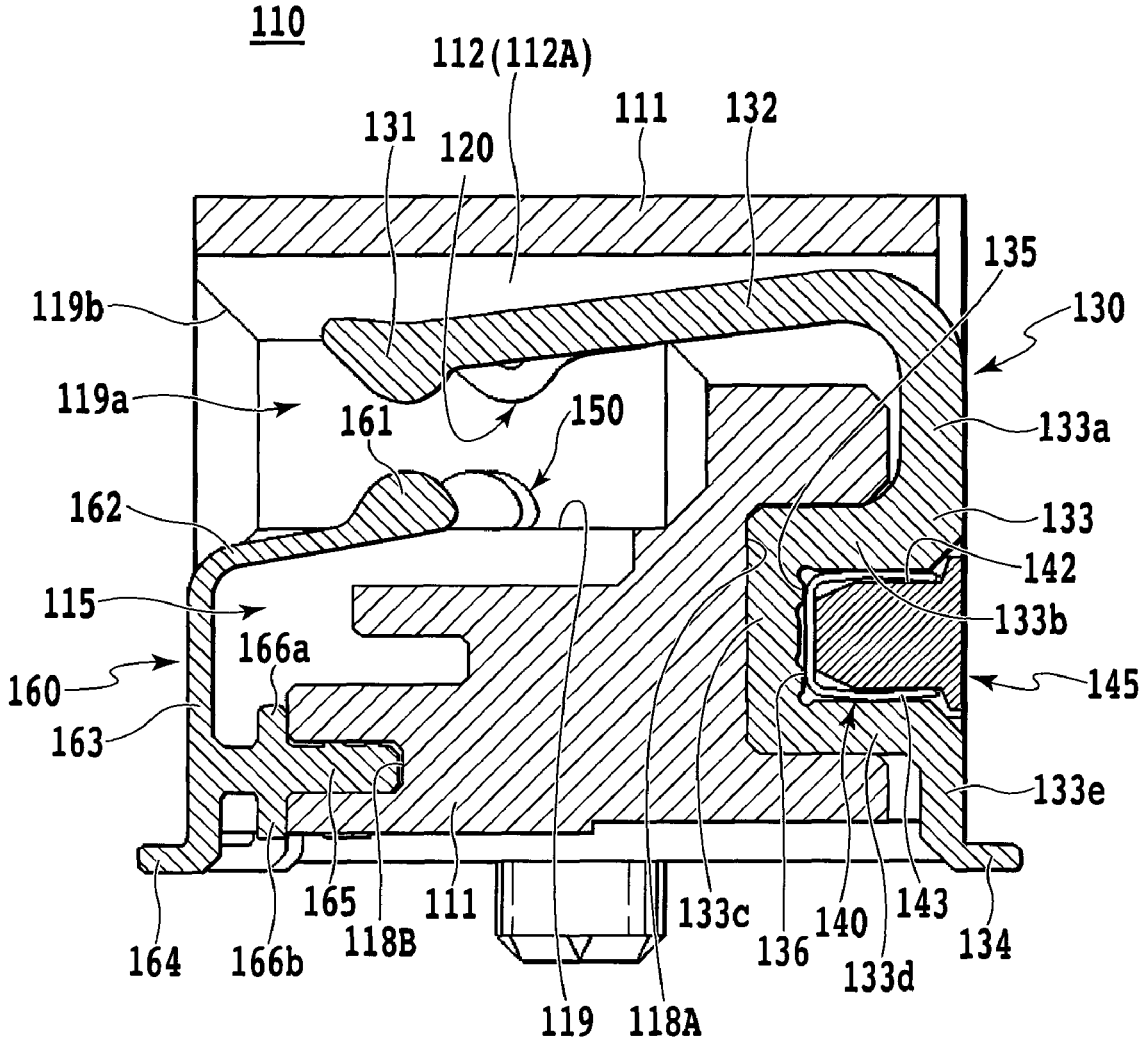
FIG. 14 is a cross-sectional view of the card edge connector according to the second embodiment, specifically, a cross-sectional view of the card edge connector taken in the vertical direction along a slit in which a ground contact is located.

Next, descriptions will be provided for the second ground contacts 160 of this embodiment. The multiple second ground contacts 160 of this embodiment are formed by punching them, each substantially in the form of the letter L, out of an electrically conductive metal thin plate. As shown in FIG. 14, each of the second ground contacts 160 includes a contact point portion 161, an elastically deformable portion 162, a fixing portion 163, and a terminal portion 164.

In this embodiment, the contact point portion 51 has a shape which is curved protruding upward, and is formed to protrude into a plug connector receiving space 119*a*, so that the contact point portion 161 can contact the second pad (not shown) serving as a corresponding external contact point of the plug connector (not shown) at a desired contact pressure.

In this embodiment, the elastically deformable portion 162 is formed to extend upward from the fixing portion 163, to extend frontward and slightly downward while curved substantially in the form of the letter L, and to be continuous with the contact point portion 161. The elastic deformable portion 162 imparts the desired contact pressure to the contact point portion 161 by means of its elastic deformation.

In this embodiment, the fixing portion 163 extends perpendicularly in the vertical direction in a way to be continuous with a vertical portion of the elastic deformable portion 162 extending in the form of the letter L. Meanwhile, the fixing portion 163 includes one press-fit protrusion 165 which extends from the fixing portion 163 at a right angle to the fixing portion 163 in the same direction (backward) as the contact point portion 161. In addition, the press-fit protrusion 165 includes two stopper protrusions 166*a*, 166*b* extending vertically from the press-fit protrusion 165. The press-fit protrusions 165 is press-fitted into the corresponding fixation press-fit hole 118B provided on the second slit of the main body 111, and securely holds the second ground contact 160 in the card edge connector 110 in cooperation with the two stopper protrusions 166*a*, 166*b*. Incidentally, although the single press-fit protrusion 165 is provided, two press-fit protrusions may be provided as in the case of the above-described first embodiment. In this case, the stopper protrusions 166*a*, 166*b* may be omitted.

In this embodiment, the terminal portion 164 is formed to extend forward and downward from the fixing portion 163, and is soldered an external contact point in the printed wiring board (not shown). Thus, the terminal portion 164 is electrically connected to an electric circuit of the printed wiring board 70.

Next, like the above-described second ground contacts 160, the multiple second signal line contacts 150 (see FIG. 14) are formed by punching, each substantially in the form of the letter S, out of an electrically conductive metal thin plate. The second signal line contacts 150 each have almost the same structure as do the second ground contacts 160, and their description is therefore omitted. Incidentally, a length from a contact point portion to a fixing portion of each second signal line contact 150 may be equal to that of each second ground contact 160, or may be slightly longer or shorter than that of each second ground contact 160.

Figure 12:
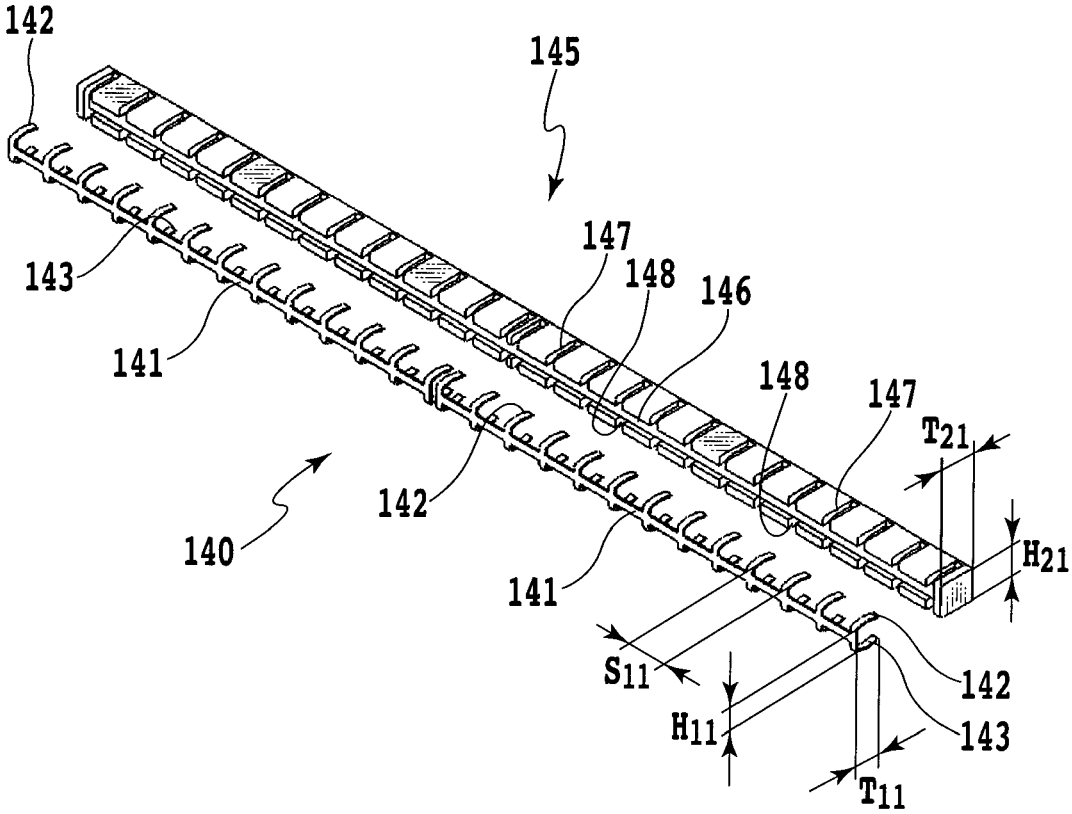
FIG. 12 is a partial perspective detailed view of a common contact and a holder according to the second embodiment which are obliquely viewed from the upper right front.

Next, the common contact 140 and the holder 145 included in the card edge connector 10 according to this embodiment, which represent a characteristic feature of the present invention, will be described with reference to FIG. 12. The common contact 140 of this embodiment is a member configured to electrically connect the multiple first ground contacts 130, which are installed in the card edge connector 110, to one another in a lump so as to equalize the electric potentials thereof. Meanwhile, the holder 145 of this embodiment is a member configured to hold the common contact 140, and to cause the common contact 140 to electrically contact the first ground contacts 130.

By providing the above-described common contact 140, this embodiment can prevent reduction in the shielding effect of the ground conductive wires in the two connector regions respectively of the plug connector and the card edge connector as in the case of the above-described first embodiment. This reduces cross talk, and prevents noise emission.

The common contact 140 of this embodiment is formed by punching out of an electrically conductive metal thin plate and bending. The common contact 140 according to this embodiment includes: an elongated main body 141 extending in the right-to-left direction; and pairs of first and second leg portions 142, 143 which can contact the first ground contacts 130. Each first leg portion 142 is preferably formed to extend almost vertically upward from the main body 141, to be then bent substantially in the form of the letter L, to extend almost horizontally backward, and to be curved in the form of a slightly upward convex shape. In order to make a pair with the first leg portion, each second leg portion 143 is preferably formed to extend almost vertically downward from the main body 141, to be then bent in the form of the letter L, to extend almost horizontally backward, and to be curved in the form of a slightly downward convex shape. As shown in FIG. 12, the multiple pairs each consisting of the first and second leg portions 142, 143 to make a pair are arranged in parallel to one another at intervals $S_{11}$. Although the two common contacts 140 are shown in this embodiment, these common contacts 140 may be combined into a single piece. Otherwise, multiple common contacts 140 may be provided. Moreover, as shown in FIG. 12, the common contact 140 according to this embodiment has a height (a length in the vertical direction) $H_{11}$ and a depth (a length in the anteroposterior direction) $T_{11}$.

Figure 13:
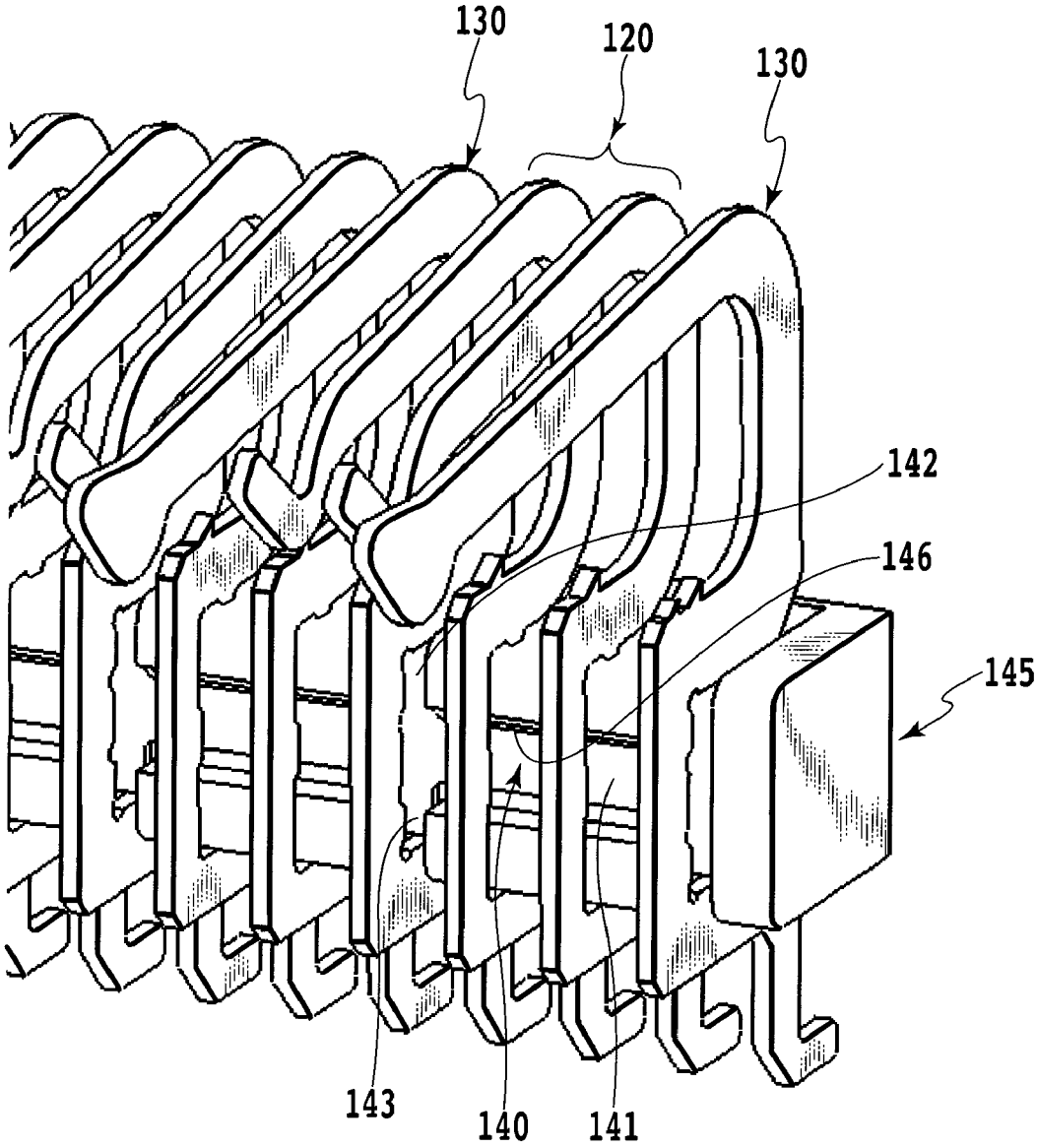
FIG. 13 is a partial perspective detailed view showing a state where ground contacts are connected together by use of the common contact shown in FIG. 12.

Because the common contact 140 are formed as described above, vertical portions of the first and second leg portions 142, 143 can contact the rear end surfaces of the vertical press-fit portions of 133*c* of the fixing portions 133 of the first ground contacts 130 when assembled, as shown in FIG. 13. Similarly, horizontal portions of the first leg portions 142 can contact the lower end surfaces of the first horizontal press-fit portions 133*b*, and horizontal portions of the second leg portions 143 can contact the upper end surfaces of the second horizontal press-fit portions 133*d*. Thereby, the common contact 140 is able to electrically connect the multiple first ground contacts 130 to one another, and to equalize the electric potentials of the multiple first ground contacts 130 as a consequence.

Next, the holder 145 for holding the common contact 140 is made of an electrically insulating synthetic resin, and is formed in a rectangular parallelepiped shape which is elongated in the right-to-left direction. As shown in FIG. 12, the holder 145 has a vertical section which is shaped like a rectangle having a height (a length in the vertical direction) $H_{21}$ and a depth (a length in the anteroposterior direction) $T_{21}$.

An elongated groove 146 being opened backward and extending in the right-to-left direction is formed in a rear surface of the holder 145 in order to receive the elongated main body 141 of the common contact 140. Meanwhile, first receiving grooves 147 extending upward from the elongated groove 146 and further extending backward in an upper surface of the holder 145 are formed in order to receive the first leg portions 142 of the common contact 140. Similarly, while paired with the first containing grooves 147, second receiving grooves 148 extending downward from the elongated groove 146 and further extending backward in a lower surface of the holder 145 are formed in order to receive the second leg portions 143 of the common contact 140. Since the holder 145 has the above-described configuration, it is understood that the height $H_{21}$ and the depth $T_{21}$ of the holder 145 are almost equal to the height $H_{11}$ and the depth $T_{11}$ of the common contact 140 ($H_{21} \approx H_{11}$, $T_{21} \approx T_{11}$), respectively. In addition, the height of the holder 145 is almost equal to the height L4 of the holder receiving recessed portion 127 of the first signal line contact 120. It goes without saying that the length in the right-to-left direction of the holder 145 is almost equal to the length in the right-to-left direction of the common contacts 140.

Figure 9:
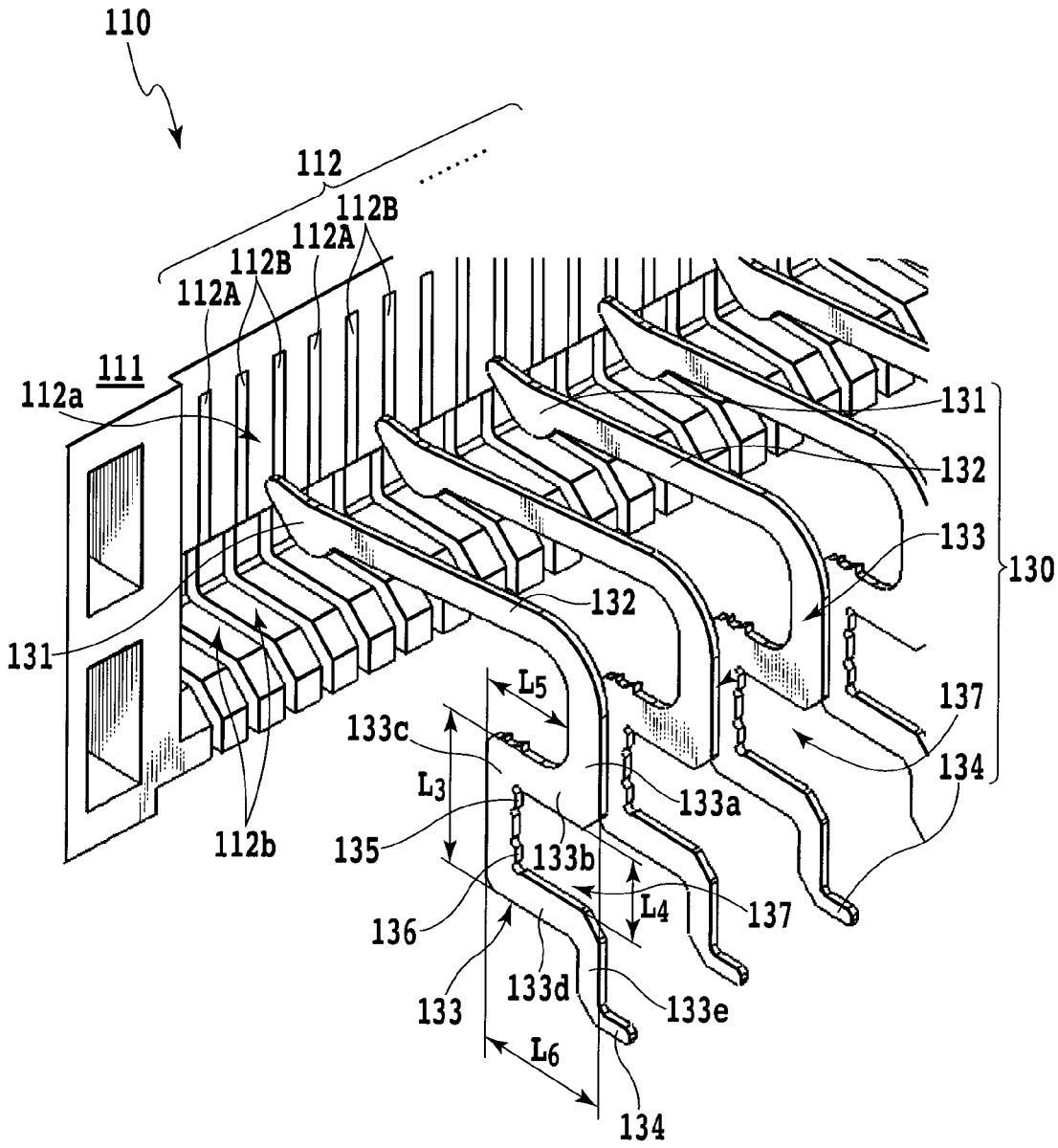
FIG. 9 is a view for explaining assembly of contacts in the card edge connector, specifically, a partial perspective view of the card edge connector shown in FIG. 8 which is viewed obliquely from the upper right back for illustrating a state of assembling ground contacts into the card edge connector.
Figure 11:
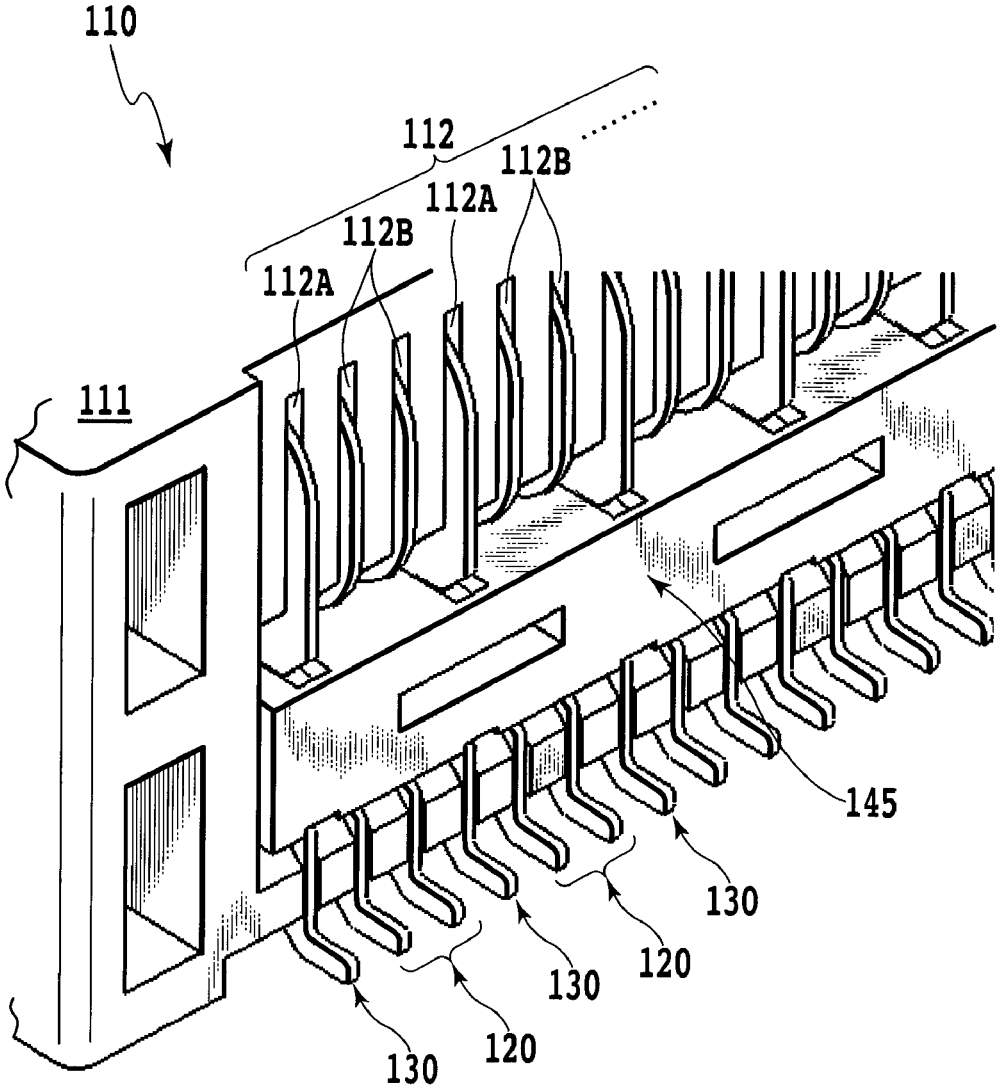
FIG. 11 is a view for explaining the assembly of the contacts in the card edge connector, specifically, a partial perspective view of the card edge connector which is obliquely viewed from the upper right back for illustrating a state where ground contacts are connected to one another by use of common contacts after the state shown in FIG. 10.

Next, incorporation of the first signal line contacts 120 and the first ground contacts 130 into the card edge connector 110 according to this embodiment will be briefly described by using FIGS. 9 to 11.

First, in this embodiment, the first ground contacts 130 are inserted into the corresponding slits 112A of the first slits 112, and are fixed to the main body 111 of the card edge connector 110, as shown in FIG. 9. The first ground contacts 130 are inserted into the respective slits 112A provided as every third slit starting from the right end (illustrated on the left end in FIG. 9). When all the first ground contacts 130 are inserted into the corresponding slits 112A, the first signal contacts 120 are subsequently inserted as shown in FIG. 10. As in the case of the above-described first embodiment, each two first signal line contacts 120, paring with each other, are respectively inserted into the corresponding two adjacent slits 112B of the first slits 112. When the attachment of the first signal line contacts 120 is completed, the common contacts 140 fitted to the holder 145 is attached to the card edge connector 110. The holder 145 is fitted into and fixed to a receiving space extending in the right-to-left direction, which is formed by the holder receiving recessed portions 127, 137 respectively provided for the first signal line contacts 120 and the first ground contacts 130 as well as the cutout recessed portions 112*b* of the partition walls 125. Thereby, the common contacts 140 held by the holder 145 can contact the corresponding first ground contacts 130 at the same time.

In this way, as shown in FIG. 11, the first signal line contacts 120 and the first ground contacts 130 are received in the corresponding first slits 112A, 112B with the G-S-S-G layout. Moreover, all the first ground contacts 130 thus received are installed in the main body 111 of the card edge connector 110 while electrically connected together by way of the common contacts 140 according to this embodiment.

As described above, by coupling all the first ground contacts 130 to one another by using the multiple common contacts 140, all the ground contacts for connecting the printed wiring boards are held at the same electrical potential. Thereby, this embodiment can also achieve the same operation and effects as those of the above-described first embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A card edge connector serving as a female connector, said card edge connector comprising:

a plurality of signal line contacts; and a plurality of ground contacts that are arranged in parallel in at least one row, wherein each of said plurality of signal line contacts includes a contact point portion adapted to contact an external contact point of a male connector at a desired contact pressure, an elastically deformable portion adapted to impart the desired contact pressure to the contact point portion, a fixing portion being held on the card edge connector, and a terminal portion being connectable to an external contact point of a printed wiring board on which the card edge connector is mounted, each of said plurality of ground contacts includes a contact point portion adapted to contact an external contact point of a male connector at a desired contact pressure, an elastically deformable portion adapted to impart the desired contact pressure to the contact point portion, a fixing portion being held on the card edge connector, and a terminal portion being connectable to an external contact point of a printed wiring board on which the card edge connector is mounted, the signal line contacts and the ground contacts are arranged in a way that every two signal line contacts for high-speed signals to send and return respectively there through are interposed between two grounds contacts, and all of the plurality of ground contacts arranged in the one row are electrically connected on one another through said fixing portions of said plurality of ground contacts by use of a plurality of common contacts, each of said plurality of common contacts includes a flat main body and two leg portions which are formed by bending right and left end portions of the flat main body, and each of said two leg portions is formed with two clamping portions clamping corresponding fixing portions of two ground contacts such as to electrically connect said two ground contacts between which the two signal line contacts are interposed.

2. The card edge connector according to claim 1, wherein each common contact is made of a metal thin plate.

3. A card edge connector serving as a female connector, said card edge connector comprising:

a plurality of signal line contacts; and a plurality of ground contacts that are arranged in parallel in at least one row, wherein each of said plurality of signal line contacts includes a contact point portion adapted to contact an external contact point of a male connector at a desired contact pressure, an elastically deformable portion adapted to impart the desired contact pressure to the contact point portion, a fixing portion being held on the card edge connector, and a terminal portion being connectable to an external contact point of a printed wiring board on which the card edge connector is mounted, each of said plurality of ground contacts includes a contact point portion adapted to contact an external contact point of a male connector at a desired contact pressure, an elastically deformable portion adapted to impart the desired contact pressure to the contact point portion, a fixing portion being held on the card edge connector, and a terminal portion being connectable to an external contact point of a printed wiring board on which the card edge connector is mounted, the signal line contacts and the ground contacts are arranged in a way that every two signal line contacts for high-speed signals to send and return respectively there through are interposed between two ground contacts, a common contact is configured to be capable of electrically simultaneously connecting the plurality of ground contacts to one another, all of the plurality of ground contacts arranged in the one row are electrically connected to one another through said fixing portions of said plurality of ground contacts by use of said common contact, said card edge connector further comprises a holder configured to hold said common contact, and each said fixing portion of said plurality of signal line contacts and each said fixing portion of said plurality of ground contacts include a holder receiving recessed portion to which the holder is attachable.

4. The card edge connector according to claim 3, wherein the common contact is made of a metal thin plate.

* * * * *